US006347642B1

(12) United States Patent
Schulte

(10) Patent No.: US 6,347,642 B1
(45) Date of Patent: Feb. 19, 2002

(54) AIR PUMP ADAPTER ASSEMBLY

(75) Inventor: Robert K. Schulte, Augusta, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/371,662

(22) Filed: Aug. 10, 1999

(51) Int. Cl.[7] ..... F16K 15/20

(52) U.S. Cl. ..... 137/231; 137/223; 137/2; 251/149.9; 285/303

(58) Field of Search ..... 137/223, 231; 251/149.8, 149.9; 285/303, 302, 298

(56) References Cited

U.S. PATENT DOCUMENTS

| | | | | | |
|---|---|---|---|---|---|
| 2,027,956 | A | * | 1/1936 | Bouser | 137/231 |
| 2,656,083 | A | | 10/1953 | Blomgren | 137/223 |
| 3,142,328 | A | | 7/1964 | Iknayan et al. | 137/231 X |
| 3,368,302 | A | * | 2/1968 | Martino | 137/223 |
| 3,536,117 | A | * | 10/1970 | Huber | 137/223 X |
| 3,923,325 | A | | 12/1975 | Slater, Jr. | 137/223 X |
| 3,926,205 | A | * | 12/1975 | Gourlet | 137/223 |
| 3,933,177 | A | * | 1/1976 | Dwyer, Jr. | 137/223 X |
| 4,256,179 | A | * | 3/1981 | Shillander | 285/303 X |
| 4,405,158 | A | * | 9/1983 | Huberman | 289/7 |
| 4,647,079 | A | * | 3/1987 | Ohlsson | 285/276 |
| 4,664,153 | A | | 5/1987 | Bishop | 137/231 X |
| 4,809,484 | A | * | 3/1989 | Lovik | 53/434 |
| 4,995,417 | A | * | 2/1991 | Naku | 137/231 |
| 5,004,013 | A | * | 4/1991 | Beaston | 137/614.05 |
| 5,156,603 | A | * | 10/1992 | Olsen | 604/323 |
| 5,226,793 | A | * | 7/1993 | Stovall | 417/437 |
| 5,439,199 | A | * | 8/1995 | Briggs et al. | 251/320 |
| 5,665,908 | A | * | 9/1997 | Burkey et al. | 73/146.8 |
| 5,746,243 | A | * | 5/1998 | Franke | 137/231 |
| 5,762,095 | A | * | 6/1998 | Gapinski et al. | 137/223 |
| 6,006,399 | A | * | 12/1999 | Massaro | 285/298 X |

* cited by examiner

*Primary Examiner*—John Rivell
*Assistant Examiner*—Meredith H Schoenfeld
(74) *Attorney, Agent, or Firm*—Kramer Levin Naftalis & Frankel LLP

(57) ABSTRACT

An air pump adapter assembly is hereby provided which includes an air pump adapter used in conjunction with an air pump adapter slide. In an exemplary embodiment, the air pump adapter includes a base and an elongated tube which further includes a series of ramps. The air pump adapter slide fits over the elongated tube of the air pump and contains a plurality of ramps in the inner diameter which allow the the slide to move cooperatively along the series of ramps on the air pump adapter.

19 Claims, 4 Drawing Sheets

AIR PUMP ADAPTER ASSEMBLY

FIELD OF THE INVENTION

The present invention relates to an air pump adapter assembly which includes an air pump adapter used in conjunction with an air pump adapter slide.

BACKGROUND INFORMATION

In general, adapters for air pumps are well known and are generally used to allow air to be pumped from the nozzle of the air pump into the air valve of an air furniture (e.g., airbed, airboat, etc.) where the size or diameter of the nozzle is different from the size or diameter of the air valve. These adapters generally consist of a straight elongated tube which connects on one end to the nozzle of the air pump and on the other end into the opening of the air valve (i.e., which is attached to an airbed, airboat or any other type of air filled furniture). One inconvenience with these conventional air pump adapters is that after a particular air furniture has been filled with air to a desired pressure, an excess amount of air often leaks out of the air valve as the adapter is being pulled out from the air valve of the air furniture before the cap can be replaced onto the valve. This excess leakage causes the air furniture to deflate somewhat, and often requires a repumping of air to inflate the air furniture back to the desired pressure.

Additionally, when using the conventional air pump adapter with the air pump, the user may accidentally pull the air pump off the air pump adapter instead of pulling the adapter out of the air valve, thereby leaving the air pump adapter on the air valve and causing excess air leakage before the cap can be replaced onto the valve. Once again, this excess leakage would result in the user having to reinflate the air furniture back to its desired pressure.

Moreover, many conventional air pump adapters are often limited to working with one particular type of air valve since each adapter is sized to fit one particular valve size. Thus, if the user wanted to use the same air pump to inflate different air furniture with different air valve sizes, the user would need to purchase a separate air pump adapter to fit each particular air valve size.

Other air pump adapters, instead of having only a single piece of elongated tube, have a first tube and a set of two second tubes in which each of the different second tubes is of a different size to correspond to a different size valve opening. The first tube is attached to the nozzle of the air pump and one of the second tubes (either of the second tubes may be used depending on the size of the valve), is inserted on one end into the first tube via a snug fit and then on the other end into the air valve of the air furniture. Like the previous single piece design, these two tube air pump adapters also have air leakage problems which occur when attempting to pull the adapter out of the air valve of the air furniture because the second tube tends to separate from the first tube and remain on the air valve. Thus, the user would have to reinflate the air furniture again to the desired pressure.

According to an exemplary embodiment of the present invention, air leakage problems and usage limitations of the prior art are overcome by providing, for example, an air pump adapter assembly including an air pump adapter used in conjunction with an air pump adapter slide.

SUMMARY OF THE INVENTION

It is an object of the present invention to provide an air pump adapter assembly which minimizes or reduces air leakage when disconnecting the air pump adapter from the air valve.

It is a further object of the present invention to provide an air pump adapter assembly which may be used with multiple types or sizes of air valves for multiple types of air furniture.

It is yet another object of the present invention to provide an air pump adapter assembly which reduces the need to reinflate the air furniture upon disengaging the air pump from the air furniture by reducing the excess air leakage upon such disengagement.

It is an object of the present invention to provide an air pump adapter assembly which reduces excess air leakages caused by the air pump adapter being accidentally detached from the air pump while the the adapter is still in the air valve of the air furniture.

It is a further object of the present invention to provide an air pump adapter assembly which conveniently allows the user to disengage the air pump adapter from the air valve by turning the air pump adapter slide in one direction.

It is yet another object of the present invention to provide an air pump adapter assembly which allows the user to secure the air pump adapter to the nozzle of the air pump.

An air pump adapter assembly is hereby provided which includes an air pump adapter used in conjunction with an air pump adapter slide. The air pump adapter slide moves cooperatively along the air pump adapter via a series of corresponding ramps on the air pump adapter and and the air pump adapter slide to address the air leakage problems of the prior art.

BRIEF DESCRIPTION OF THE DRAWING

FIG. 8 is a front view of an alternative embodiment of the air pump adapter assembly showing the levers in a first position.

FIG. 9 is a front view of an alternative embodiment of the air pump adapter assembly showing the levers in a second position.

DETAILED DESCRIPTION OF THE INVENTION

Figure 1:
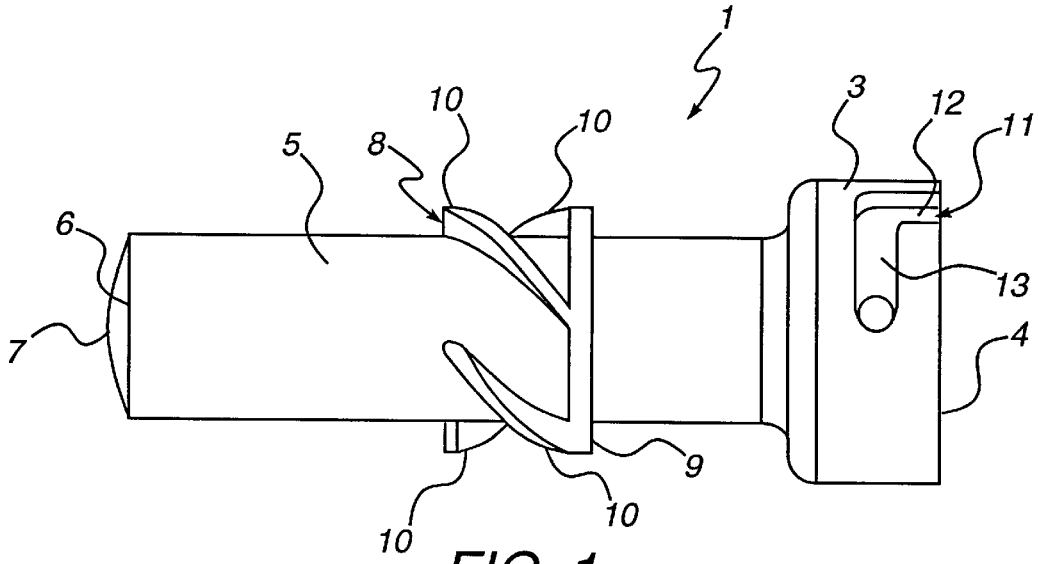
FIG. 1 is a side view of an exemplary air pump adapter according to an embodiment of the present invention.

The present invention includes an air pump adapter assembly having, for example, two parts: (a) the air pump adapter 1, and (b) the air pump adapter slide 2. The air pump adapter 1 includes, for example, a base 3, with a base opening 4 on one end, connected to an elongated tube 5, which has a valve insertion opening 6 at the other end. The base 3 is shaped so that it will fit and connect with the nozzle of an air pump (not shown). On the other end, the elongated tube 5 is shaped and sized so that it will fit into the air valve opening of a particular air furniture. Thus, the elongated tube can have variable length and diameters as needed.

As shown in the exemplary embodiment illustrated in FIG. 1, the base 3 of the air pump adapter 1 is sized and shaped to fit onto, for example, the Bulton™ 4D air pump manufactured for the Coleman Company of Wichita, Kans., and the elongated tube 5 of the air pump adapter is made so that it can fit into the Bulton™ air valve. The size and shape of the air pump adapter (both the base and elongated tube portion) may be modified to fit any other air pump or air valves as desired.

Additionally, the valve insertion opening 6 may also have other configurations attached thereto which will allow the adapter 1 to fit or work with other types of air valve. For example, in FIG. 1, the valve insertion opening 6 has a rib 7 or a raised bar located across the middle of the opening 6 so that the adapter 1 may operate with certain types of valves known as Aerovalves™, which are often found on conventional airbeds. As with the Aerovalves™, the rib 7 or raised bar may be used on other air valves which have a spring loaded valve opening to maintain an open position to allow air to flow into the valve. In this particular embodiment, no change in the size of the elongated tube is needed since these Aerovalves™ have the same size opening as the Bulton™ air valves. Other configurations may be used to fit other types of air valves as necessary.

Figure 2:
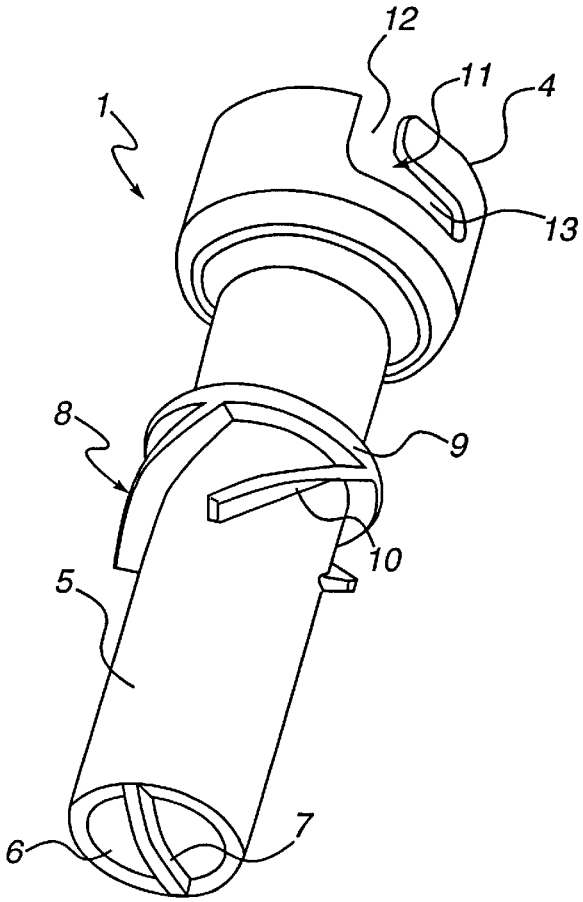
FIG. 2 is an angled side view of the air pump adapter of FIG. 1.

Moreover, as shown in FIGS. 1 and 2, the air pump adapter 1 also has a series (e.g., collection) of "ramps" 8 which protrude outward from the elongated tube 5. These ramps 8 may take on certain shapes or patterns. For example, these ramps 8 may extend in a clockwise or counterclockwise direction from one end of the tube to the other. In an exemplary embodiment of the present invention, there is a concentric base ramp 9 attached to the elongated tube 5 approximately a half inch from the base 3 along with four projecting ramps 10 which extend approximately a half inch in a clockwise spiral direction toward the valve insertion opening 6 end of the tube. Other shapes and patterns of these ramps may be used or varied as desired. In other words, orientation of the ramps can be configured to ensure proper operation of a valve, e.g., insertion opens the valve for air flow and removal closes the valve to prevent the escape of air.

At the base 3 of the air pump adapter 1 there may exist slots 11 which can be used to fit over any taps (if any) which are located on the nozzle of the air pump. In other words, a pair of slots 11 (only one is shown, the other is on the opposite side) would insert into a pair of taps on the air pump nozzle (not shown) to further secure the air pump adapter to the air pump nozzle, thus, preventing any accidental separation of the adapter from the nozzle, which is often the case with adapters which are secured to the nozzle only by a snug fit. Such slots 11 should include, for example, insertion slots 12 connected to perpendicular slots 13. The perpendicular slots 13 extend in opposite directions from each other so that the base 3 may be twisted in a counterclockwise direction to further secure the air pump adapter 1 to the air pump nozzle. Conversely, the perpendicular slots 13 may also be reversed so that the base 3 may be twisted in a clockwise direction instead.

Figure 3:
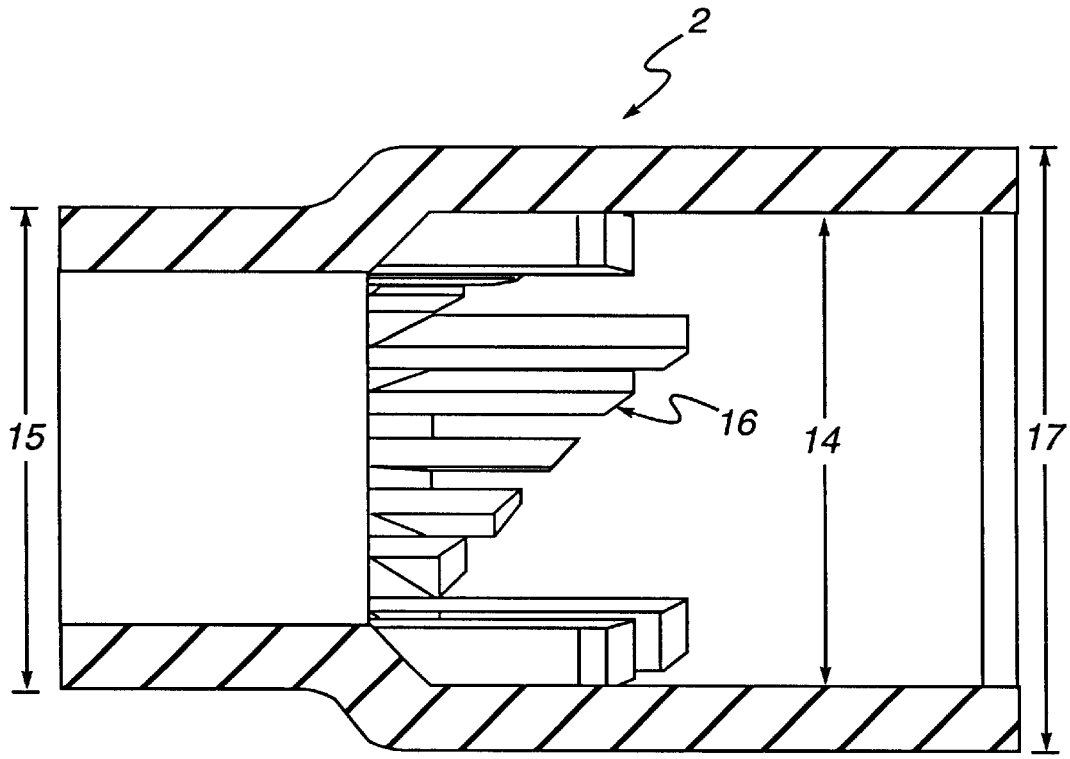
FIG. 3 is a cross sectional side view of an exemplary air pump adapter slide according to an embodiment of the present invention.

The air pump adapter slide 2, illustrated in cross-section in FIG. 3, is designed, shaped, and sized to fit, for example, over the elongated tube 5 of the air pump adapter 1. Thus, slide 2 will have, for example, an inner diameter 14 that is at least as big as the outer diameter of the elongated tube 5 of the air pump adapter 1.

The top outer diameter 15 of the air pump adapter slide 2 may be shaped or sized to fit other types of valves, thereby allowing the user to use the same air pump adapter 1 for two different size valves without having to change the air pump adapter. The top outer diameter 15 of the air pump adapter slide 2 has been designed, for example, so that it will fit into a Boston™ valve, which are often found on boats, according to an exemplary embodiment of the present invention. The bottom outer diameter 17 of the slide 2 may be even bigger than the top outer diameter 15 to prevent, for example, the entire adapter assembly from being swallowed into an air valve having an opening larger than that of the top outer diameter 15.

Furthermore, as shown in FIG. 3, the air pump adapter slide 2 may have a series of corresponding ramps 16 along the inside of the slide 2 which will work in conjunction with the pattern, design, or shape of the ramps 10 located on the elongated tube 5 of the air pump adapter 1. These ramps 10 allow the slide 2 to be movably cooperative with the air pump adapter 1 in that, for example, the slide 2 may move along adapter 1 via the length of these ramps 10. According to an exemplary embodiment of the present invention, since the ramps 10 on the air pump adapter 1 are oriented in a spiral clockwise direction, the air pump adapter slide 2 can have a plurality of ramps 16 which allow the slide, when placed onto the adapter, to be twisted in a clockwise direction from the concentric ramp base 9 towards the valve insertion opening 6 of the elongated tube 5. This twisting or turning of the slide 2 in a clockwise direction causes the slide 2 to move along the length of the ramps 10 on the adapter 1 away from the concentric base ramp 9 and toward the valve insertion opening 6. If these ramps on the adapter were patterned in a counterclockwise direction, then the corresponding ramp in the slide 2 would also be designed to allow the slide 2 to be turned in the proper counterclockwise direction. Nevertheless, the shape, pattern, and design of these corresponding ramps on the slide may vary depending on the ramps on the air pump adapter are structured.

In the exemplary operation, the air pump adapter 1 is first attached to the nozzle of the air pump (not shown). The attachment may be based on a sized fit between the base of the adapter and the nozzle, may involve the use of slots or any other method known in the industry. The attachment is secured by way of, for example, a sized fit and a pair of slots, which includes insertion slots 12 (only one insertion slot is shown, the other being on the opposite side) corresponding with the tap on the nozzle of the air pump, and perpendicular slots 13 (only one perpendicular slot is shown, the other being on the opposite side) which allows the user to twist the base 3 in a counterclockwise direction to "lock" the adapter 1 onto the nozzle.

Figure 4:
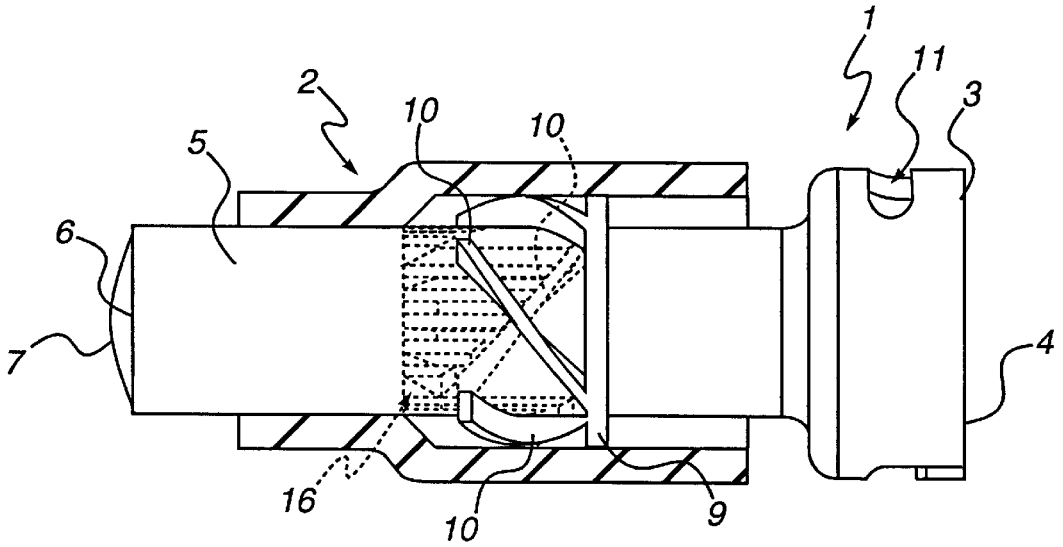
FIG. 4 is a cross sectional side view of the air pump adapter slide of FIG. 3 as initially placed onto the air pump adapter of FIG. 1.
Figure 5:
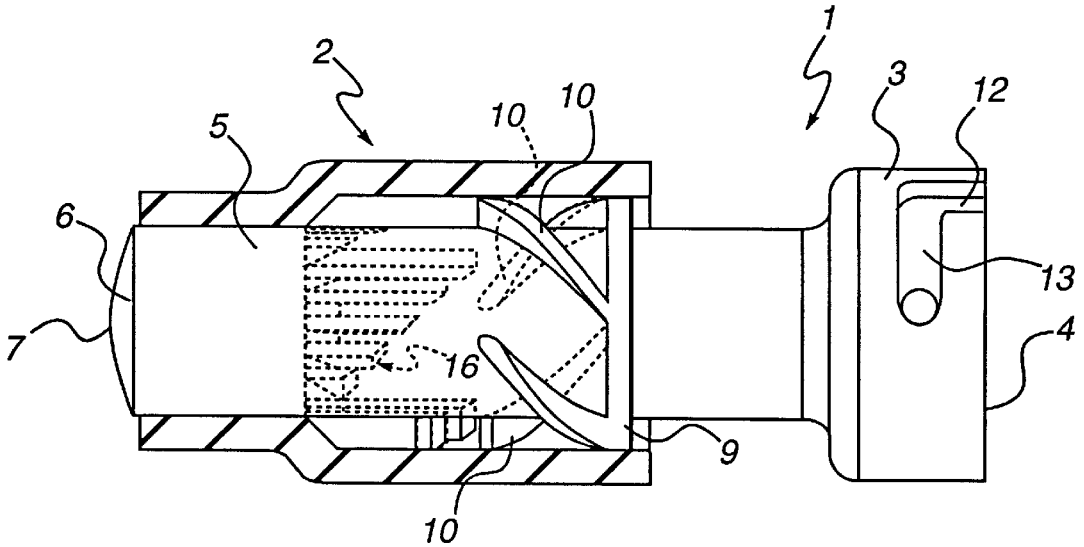
FIG. 5 is a cross sectional side view of the air pump adapter slide on the air pump adapter after the slide is turned in a counterclockwise direction on the air pump adapter.
Figure 6:
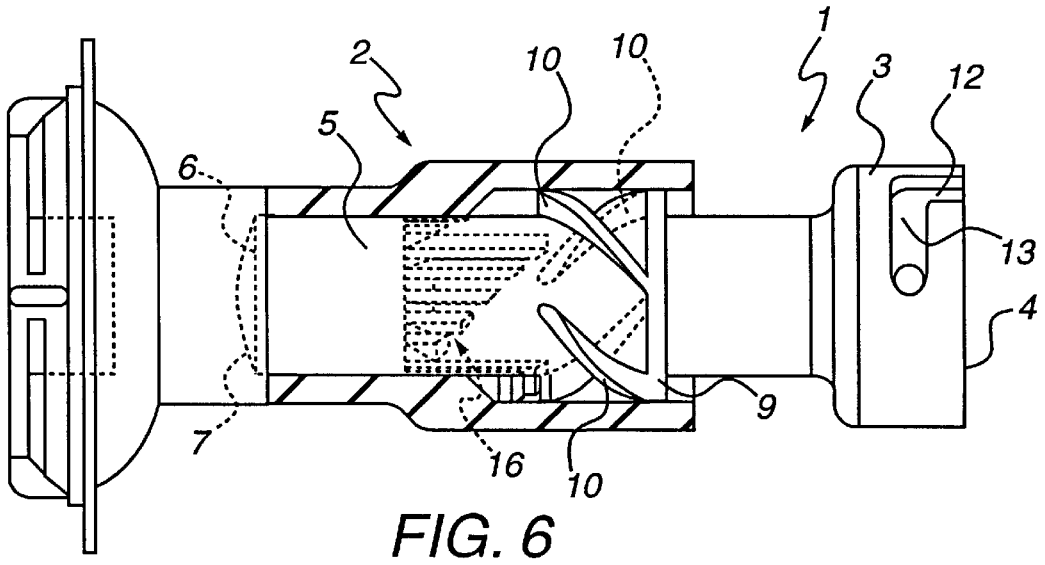
FIG. 6 is a side view of an exemplary embodiment of an air pump adapter assembly before insertion into a Double Locke™ valve.
Figure 7:
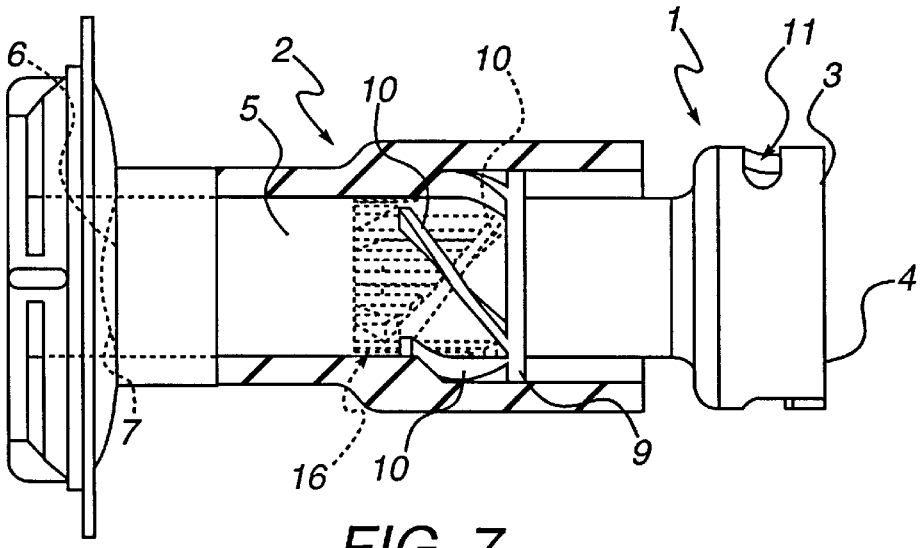
FIG. 7 is a side view of an exemplary embodiment of an air pump adapter assembly fully inserted into a Double Lock™ valve.

Once the air pump adapter 1 has been secured to the nozzle, the air pump adapter slide 2 is then, for example, slid over and onto the elongated tube 5 of the air pump adapter 1 toward the base 3. The air pump adapter slide 2 may initially come to a halt when the ramps 16 located in the inside diameter 14 of the slide 2 comes into contact with the ramps 10 on the elongated tube 5. Since these ramps 10 have been patterned in a spiral clockwise direction from the concentric base ramp 9 toward the valve insertion opening 6 of the elongated tube, the air adapter slide 2 may be turned in the opposite (counterclockwise) direction so that the air adapter slide 2 will move toward the base 3 of the adapter 1 until it can go no further (e.g., when the ramps 16 on the inside diameter 14 of the slide 2 abuts the concentric base ramp 9 on the adapter 1). This will allow, for example, approximately a half inch of the elongated tube 5 of the air pump adapter 1 to be showing above the top of the slide 2. (See FIG. 4).

Once this assembly is completed, the elongated tube 5 of the air pump adapter 1 is inserted into the valve (e.g., Bulton™ air valve or Aerovalve™) of the air furniture until the top of the slide 2 abuts the opening of the air valve. Because the top outer diameter 15 of slide 2 is larger than the opening of the air valve, the slide 2 prevents the adapter 1 from further entering the valve. With the Boston™ valve, however, the top outer diameter 15 of the air pump adapter slide 2, along with the elongated tube 5 above the slide may be inserted into the valve since the top outer diameter 15 was made (in this exemplary embodiment) to fit such valve. The bottom outer diameter 17 of the slide 2, being larger than the opening of the Boston™ valve, prevents the rest of the air adapter assembly from being pushed further into the valve. Once the assembly is inserted, the user may begin pumping air into the air furniture.

When the air furniture has been completely filled or filled as desired, the user then, for example, turns the air pump adapter slide 2 in the clockwise direction (since the ramps 10 are designed in this direction). This turning of the slide 2 causes the air pump adapter 1 to be pushed out of the air valve. This way, the user does not need to physically pull the air pump adapter 1 out of the valve, thereby preventing the excess air leakage which would result from such pull. In other words, by twisting the air adapter slide 2, the air pump adapter 1 is merely pushed out of the air valve since the slide 2 abuts the opening of the valve and is moved along the length of the ramps 10 of the adapter 1 to the valve insertion opening 6 end as the adapter 1 retreats away from the valve. Alternatively, the user may choose to turn the adapter 1 in a counterclockwise direction instead of the slide 2, or the user may choose to turn both the adapter 1 and slide 2 in their respective clockwise and counterclockwise directions. All three alternatives causes the slide 2 to move along the length of the ramps 10 of the adapter 1. Thus, excess air leakage is reduced and kept to a minimum while the adapter 1 is being withdrawn from the air valve. When the air adapter slide 2 has been moved to the end of the length of the ramps 10, the valve insertion opening 6 end of the adapter 1 may be out or almost out of the valve, and thus, the user may simply slide the air pump adapter assembly away from the air valve and quickly close the air valve with the valve cap before any excess air escapes.

When an exemplary embodiment of an air pump adapter assembly according to the present invention is used with Double Lock™ valves, which are often found in beds and other air furnitures, the air pump adapter slide 2 serves a second function in that by turning the slide 2, it not only pushes the air pump adapter out of the Double Lock™ valve, but it also pushes the Double Lock™ valve into its first closed position so that the first "lock" of the Double Lock™ is engaged. This prevents the user from having to manually push in the Double Lock™ valve into this first closed position, which is often awkward when also holding the air pump and also leads to further excess air leakages.

Alternatively, the air pump adapter 1 may be used with a set of levers 18 which, on the one end 20, abut the rim of the valve opening or the top of slide 2, and on the other end 19, extends toward the the base 3 of the adapter 1 and includes a pivotal hinge 21 in between the two ends 19 and 20 of the lever 18. The end of the lever 19 which extends toward the base 3 of the adapter 1, similar to the operation of a cork bottle opener, may then be used as a handle in which by pulling that end 19 toward the direction of the air valve (made possible by the pivotal hinge 21), the lever end 20 which abuts the rim of the valve opening or the top of slide 2 pushes the adapter out of the air valve much the same way the levers on a cork bottle opener would cause the cork to be pushed out of the bottle.

According to an exemplary embodiment of the present invention, not only can the user use the same air pump adapter assembly with more than one type of air valve, but the user also reduces excess air leakages caused by the user pulling the adapter from the valve. Those skilled in the art will realize that various changes and modifications may be made to the present invention without departing from the spirit of the invention and it is intended to claim all such changes and modifications as falling within the scope of the invention.

What is claimed is:

1. An air pump adapter assembly comprising:

an air pump adapter, said adapter including a base having a base opening, an elongated tube connected to the base on one end and having a valve insertion opening on the other end, a series of ramps, and a concentric base ramp, wherein both the series of ramps and the concentric base ramps are on the elongated tube; and an air pump adapter slide which is movably cooperative with the air pump adapter.

2. The air pump adapter assembly of claim 1, wherein the series of ramps are oriented in a spiral counterclockwise direction from the concentric base ramp toward the valve insertion opening.

3. An air pump adapter assembly comprising:

an air pump adapter, said adapter including a base having a base opening, an elongated tube connected to the base on one end and having a valve insertion opening on the other end, and a rib positioned across the valve insertion opening; and an air pump adapter slide which is movably cooperative with the air pump adapter.

4. An air pump adapter assembly comprising:

an air pump adapter, said adapter including a base having a base opening, an elongated tube connected to the base on one end and having a valve insertion opening on the other end, ramps on the elongated tube, and a rib positioned across the valve insertion opening; and an air pump adapter slide which is movably cooperative with the air pump adapter.

5. The air pump adapter assembly of claim 1, wherein the air pump adapter further comprises a rib positioned across the valve insertion opening.

6. An air pump adapter assembly, comprising an air pump adapter, said adapter including a base having a base opening, an elongated tube connected to the base on one end and having a valve insertion opening on the other end, and ramps on the elongated tube; and an air pump adapter slide which is movably cooperative with the air pump adapter, said air pump slide comprising an inner diameter, an outer diameter, and a plurality of ramps which correspond to the design of the ramps on the elongated tube.

7. The air pump adapter assembly of claim 1, wherein the air pump adapter slide comprises all inner diameter, an outer diameter, and a plurality of ramps which correspond to the design of the ramps on the elongated tube.

8. The air pump adapter assembly of claim 7, wherein the air pump adapter slide further includes a plurality of ramps which correspond to the design of the ramps on the elongated tube such that the turning of the slide in one direction operates to move the slide along the ramps of the elongated tube.

9. The air pump adapter assembly of claim 7, wherein the air pump adapter slide further includes a top outer diameter, and a bottom outer diameter which is larger than the top outer diameter.

10. An air pump adapter assembly comprising, an air pump adapter, said adapter including a base opening, a base, a elongated tube connected to tho base on one end and having a valve insertion opening on the other end, a series of ramps, and a concentric base ramp, wherein both the series of ramps and the concentric base ramp are on the elongated tube; and an air pump slide which is movably cooperative with the air pump adapter.

11. The air pump adapter assembly of claim 10, wherein the air pump adapter further comprises a rib positioned across the valve insertion opening.

12. The air pump adapter assembly of claim 10, wherein the air pump adapter further includes slots on the base.

13. The air pump adapter assembly of claim 10, wherein the air pump slide further comprises an inner diameter, an outer diameter, and a plurality of ramps which correspond to the design of the ramps on the elongated tube.

14. The air pump adapter assembly of claim 13, wherein the air pump adapter slide further includes a plurality of ramps which correspond to the design of the ramps on the elongated tube such that the turning of the slide in one direction operates to move the slide along the ramps of the elongated tube.

15. The air pump adapter assembly of claim 13, wherein the air pump adapter slide further includes a top outer diameter, and a bottom outer diameter which is larger than the top outer diameter.

16. An air pump adapter assembly comprising, an air pump adapter including a base opening, a base having one or more slots, and a elongated tube connected to the base on one end and having a valve insertion opening on the other end, wherein a rib is positioned across the valve insertion opening, the elongated tube further comprising a series ramps extending from a concentric base ramp toward the valve insertion opening, and an air pump slide including an inner diameter an outer diameter, and a plurality of ramps in the inner diameter designed to correspond with the series of ramps on the elongated tube.

17. An air pump adapter assembly comprising, an air pump adapter comprising a base opening, a base having one or more slots, a elongated tube connected to the base on one end and having a valve insertion opening on the other end, wherein a rib is positioned across the valve insertion opening, and ramps on the elongated tube in between the base and valve insertion opening, and an air pump slide comprising an inner diameter an outer diameter, and a plurality of ramps in the inner diameter designed to correspond with the ramps on the elongated tube.

18. The air pump adapter assembly of claim 16, wherein the air pump slide further includes a top outer diameter and a bottom outer diameter which is larger than the top outer diameter.

19. The air pump adapter assembly of claim 17, wherein the air pump slide further includes a top outer diameter and a bottom outer diameter which is larger than the top outer diameter.

* * * * *